US006393816B1

(12) United States Patent
Hattori

(10) Patent No.: US 6,393,816 B1
(45) Date of Patent: May 28, 2002

(54) MOTOR SYSTEM FOR DIRECTLY DRIVING SPINDLES OF SPINNING MACHINE

(76) Inventor: Motonobu Hattori, 26-19, Mitsuwadai 3-chome, Chiba 264-0032 (JP)

( * ) Notice: Subject to any disclaimer, the term of this patent is extended or adjusted under 35 U.S.C. 154(b) by 0 days.

(21) Appl. No.: 09/936,867

(22) PCT Filed: Mar. 14, 2000

(86) PCT No.: PCT/JP00/01539

§ 371 (c)(1),
(2), (4) Date: Sep. 14, 2001

(87) PCT Pub. No.: WO00/55404

PCT Pub. Date: Sep. 21, 2000

(30) Foreign Application Priority Data

Mar. 15, 1999 (JP) ..... 11-109861
Mar. 29, 1999 (JP) ..... 11-124613
Apr. 19, 1999 (JP) ..... 11-147011

(51) Int. Cl.[7] ..... D01H 13/00
(52) U.S. Cl. ..... 57/100
(58) Field of Search ..... 57/92, 100, 102, 57/78, 81, 88

(56) References Cited

U.S. PATENT DOCUMENTS 4,908,534 A * 3/1990 Gubler et al. ..... 310/258
4,931,705 A * 6/1990 Wieczorek ..... 57/100
5,161,361 A * 11/1992 Talley et al. ..... 57/100
5,572,859 A * 11/1996 Derichs et al. ..... 57/100
5,906,092 A * 5/1999 Hattori ..... 57/100

FOREIGN PATENT DOCUMENTS

DE 3818196 * 12/1989
DE 3838418 * 5/1990
JP 11-247035 * 9/1999

* cited by examiner

*Primary Examiner*—Danny Worrell
(74) *Attorney, Agent, or Firm*—Arnold B. Silverman; Eckert Seamans Cherin & Mellott, LLC

(57) ABSTRACT

A mounting of a motor system for directly driving spindles of a spinning machine, wherein individual motors are provided that are superior in insulation property, having a housing construction formed by electric insulation means, each power supply line branch in which the changing part of each power supply line is exposed is shifted in the direction of the length to provide a distance for insulation, the power supply lines being disposed close to each other to provide wiring systems of reduced size, which, together with the peripheral systems, are mounted in front of the housings of the individual motors; thus, the construction of the system can be made safe, small in size and simplified, having the effect of reducing the costs.

12 Claims, 12 Drawing Sheets

MOTOR SYSTEM FOR DIRECTLY DRIVING SPINDLES OF SPINNING MACHINE

BACKGROUND OF THE INVENTION

1. Field of the Invention

The present invention relates to the spindle direct motor drive system of a spinning machine such as ring spinning machine, ring twister machine, and double twister machine.

2. Prior Art

FIG. 1 and FIG. 2 show respectively the examples of the first system and the second system of a plurality of individual motors for driving individually and directly a plurality of spindles which are arranged on spindle rails installed in the full length of spinning machine, the wiring system and the peripheral system. In general, the power source voltage of the spinning machine which consumes about 30~50 kVA is mainly the alternating 400V class.

FIG. 1 or the first system is the one that all of the individual motors 3 are drove by a large capacious inverter 72, and after the alternating current voltage of power source 6 is converted to the direct current voltage by the voltage converter 7l,the alternating current power is supplied from the inverter 72 to the individual motors 3, through the power supply lines 4, the power supply line branches 4*b* of the each individual motors 3 and switches 102 of which the movements are synchronized with the braking devices 101.

FIG. 2 or the second system is the one that every individual motor 3 or every several individual motors 3 is controlled by each control mean (invertor in case of this example) 8, and is the one that after the alternating current voltage of power source 6 is converted to the direct current voltage by the voltage converter 71, the direct current power is supplied to every inverter 8 through the power supply lines 4 and the power supply line branches 4*b* and is converted to the alternating current voltage again by each inverter 8 and the alternating current power is supplied from each inverter 8 to every individual motor 3 through the connecting wires 4*c*. Moreover, the signal line 5 is connected with invertor 8 by the signal line branch 5*b,* and The stop switch 103 is the one to instruct each invertor 8 to stop or start the spindle 2 individually.

In any of the first system and the second system, because that one phase of the alternating current power supply 6 is usually grounded and in addition the voltage converter 71 is not an insulation type, the individual motors 3 should have the characteristic to be proof against the voltage and the insulation characteristic which corresponds to the power supply voltage against the earth.

FIGS. 3–7 show the conventional technologies. FIG. 3 shows the conventional exempla of the individual motor 3's structure. The stator 3*a* comprises the stator core 3*a*1 made of the silicon steel board and the electric winding wire 3*a*2 and the stator 3*a* is supported by the mean that the metallic housing 3*c* engages the edge of the stator core 3*a*1's outer part. The metallic housing 3*c* is molded as one body with the holder 3*d* of the spindle's bolster 2*a* into which the bolster 2*a* is pressed and fit. On the other hand, the rotor 3*b* into which the spindle rotating part 2*b* is pressed and fit rotates at high speed inside of stator 3*a*. The individual motor 3 should have the characteristic to be proof against the voltage which corresponds to the power source voltage against the earth. And because the metallic housing 3*c* of the individual motor 3 is connected with the frame of the machine electrically, only the insulator of the stator winding wire 3*a*2 should have the characteristic to be proof against the voltage. By any chance if the insulation of this stator winding wire 3*a*2 is destroyed and if the earth resistance is large or the frame of the machine is imperfectly grounded, it is very dangerous because the power supply voltage appears on the metallic housing 3*c* of individual motor 3 which person's hand can touch easily. Because of the restriction that it is necessary to secure the insulating distance to be proof against the voltage, it is not easy to install compactly the switch 102 of FIG. 1, the inverter 8, the stop switch 103 of FIG. 2 and etc. on the metallic housing 3*c*.

FIG. 4 shows a conventional example of the wiring system of the first system and electric power supply lines or naked bars, 41, 42, and 43 which are arranged and partially embedded in the wiring duct 161 made of the insulation resin, being the distance apart from each other (in this case, surface distance) for insulating according to the power supply voltage.

FIG. 5 shows a conventional structure example of individual motors 3, the wiring system and the peripheral system of the second system and power supply lines 41 and 42 which supply the direct current power and signal lines 51 are arranged in the wiring duct 161 being the distance apart from each other for insulating according to the power supply voltage, and they are installed under the spindle rail 1. Invertor 8, stop switch 103, control materials 104 and the wiring of power supply line branches 4*b,* signal line branches 5*b* and connected wires 4*c,* etc. are arranged in housing 17, and they are installed for each spindle as covering the individual motor 3, the lower side of spindle 2, the spindle rail 1 and the wiring duct 16.

In the wiring system of FIG. 4, and the wiring system and the peripheral system of FIG. 5, power supply lines 4 of the machine of the alternating current power source 400V class should be the electric wires with the corresponding diameter or thickness, also including the peripheral system, they should be surely the distance apart from each other for insulating according to the voltage. In addition, they should have the safety structure that person's hand does not touch easily and the sealing up structure that the rubbish of a minute fiber which floats in the air does not invade. For such a reason, the size of the wiring system and the peripheral system are considerably large and their structure become complex. A large space is necessary to install them inside of the machine, and then it's not easy to install them anywhere inside of the machine.

FIG. 6 shows a conventional example of the signal transmission system that is necessary in the individual motor 3, the wiring system and the peripheral system of the second system. There are speed set value signal, drive/stop signal, brake signal, motor restrain signal and so on as control signals sent to the inverter 8 from the controller 11 that controls the machine entirely and there are error signal, error type indicate signal and so on as a status signals sent to the controller 11 from the inverter 8. In the spinning machine of which total length reaches to as many as 20–40 m, it is not practical to transmit the control signal and the status signal as parallel and digital signals even on the mounting side and the cost side because quite a lot of wiring are needed. FIG. 6 is the example of the local network (LAN) system that processes these signals as the serial communications between multi bureaus.

FIG. 7 shows a main circuit composition of each bureau in the LAN system. In this LAN system, the coaxial cable of exclusive use or the twisted pair lines are used as a transmission medium and in each bureau 9 (each invertor 8 is included) and the relay circuits 12, the special driving/ receiving circuit 9*d* for transmission are used which can drive about 100 bureaus, so the LAN system is the general purpose and highly developed serial communication system which can transmit the signal in both directions to over several hundred meters distantly.

In serial communication system (LAN) between multi bureaus showing in FIG. 6 and FIG. 7, each composition element has generality based on each role. For the use as the spindle direct motor drive system of the spinning machine in which a small amount of data are transmitted in both directions between 500–1000 inverters 8 that are arranged in right and left side of the machine and the controller 11 that controls the machine entirely within the range of about 20–40 m, total machine length, the specification of the composition element of LAN is excessive, and mounting LAN is difficult and invites great costs.

The object of the present invention is to solve some problems mentioned above about the installation of the individual motors for driving directly the spindles, the wiring system and the peripheral system, to make the structure of the system safe, small and simple, and to decrease the cost of the system.

SUMMARY OF THE INVENTION

The First Characteristic of Composition

Spinning machine includes a plurality of spindles which are arranged on the spindle rail installed in the direction of length of spinning machine, and a plurality of individual motors provided each for said spindle, for driving said spindles directly and individually. It is characterized by that the spindle direct motor drive system of spinning machine comprises the hard electric insulation mean between the stator of the said individual motor and the holder of the said spindle's bolster to support the bolster, which unites and covers the stator and the holder when it molds, and shapes the housing of the said individual motor.

The First Effect

According to the first characteristic of composition, as that there is hard electric insulation mean between the stator of the said individual motor and the holder of the said spindle's bolster to support the bolster and it unites and covers the stator and the holder when it molds and shapes the housing of the said individual motor, even if the insulation destruction of the stator winding wire happens by any chance, the power supply voltage does not appear to the housing of an individual motor and the spindle bolster for person's hand to touch easily due to the insulation characteristic of the housing's material and structure. So there is no worry of the electric shock and the safety is secured. Also there is the effect that the wiring and the peripheral system such as electric parts can be mounted easily and small on the housing made of insulator.

The Second Characteristic of Composition

Spinning machine includes a plurality of spindles which are arranged on the spindle rail installed in the direction of length of spinning machine, and a plurality of individual motors provided each for said spindle, for driving said spindles directly and individually. It is characterized by that the spindle direct motor drive system of spinning machine comprises at least two power supply lines for supplying power being arranged along the said spindle rail, and the power supply branch points at which the conductive parts of the said power supply lines are exposed and from which the electric power are supplied to the said individual motors directly, or indirectly through the control means for controlling one or more of the said individual motors and also which are at least the distance apart from each other for insulation corresponding to the voltage between each other of the said power supply lines, in the direction of the length of the said power supply lines.

The Second Effect

According to the second characteristic of composition, as that the power supply branch points at which the conductive parts of the said power supply lines are exposed, are at least the distance apart from each other for insulation corresponding to the voltage between each other of the said power supply lines, in the direction of the length of the said power supply lines, the said power supply lines can be arranged adjacently and there is the effect that the size of the wiring system can be minimized. As the restriction about the place for installing the wiring system decreases further, for example the installing it in front of the housing of an individual motor becomes easier.

The Third Characteristic of Composition

In addition, spindle direct motor drive system of spinning machine as characterized in claim 2, is characterized by that the said power supply lines are composed of naked lines enclosed and insulated by the insulated resin made duct except the power supply branch points, and there is the hard electric insulation mean between the stator of the said individual motor and the holder of the said spindle's bolster to support the bolster and it unites and covers the stator and the holder when it molds, and shapes the housing of the said individual motor, and the said power supply lines are covered and supported by the second housing in front of the said individual motor housing.

The Third Effect

In addition to the effect of claim 2, according to the third characteristic of composition, because the said power supply lines are composed of naked lines enclosed and insulated by the insulated resin made duct except the power supply branch points, the work of removing the insulating coating of wires is not necessary and the electric power supply branch lines can be connected by means of inserting only the plugs attached at the end of the branch wires to the holes of the naked lines. And then, there is the effect that the assembly work becomes easy. Also by ribbing on the insulated resin made duct, the said power supply branch points should secure the surface distance apart from each other for insulation and so the distance between the power supply branch points can be reduced further, there is the effect that the size of the wiring system can be minimized.

Because that the said power supply lines are covered and supported by the second housing in front of the said motor housing which the electric insulation mean covers and shapes when it molds, the conventional sizable place or space are not specially necessary for installing the wiring duct. Also, it is possible to mount concentrically the inverter for controlling every one or more of the said individual motor, the power supply line branches, the control means and so on, with the power supply lines in front of the housing of the individual motors. This concentrated mounting will bring the effect of a redoubled miniaturization because of being able to omit connecting wires, control means and so on.

The Fourth Characteristic of Composition

Spinning machine includes a plurality of spindles which are arranged on the spindle rail installed in the direction of length of spinning machine, and a plurality of individual motors provided each for said spindle, for driving said spindles directly and individually. It is characterized by that the spindle direct motor drive system of spinning machine comprises the control means for controlling one or more of the said individual motors which are arranged for every one or more of the said individual motors, and at least one signal line which is divided into the length corresponding to a fixed number of the said control means and is connected to each of the fixed number of the said control means through the receiving circuit or the receiving and driving circuits for transmitting the signal in one direction or both directions between the said signal line and each of the said control means, and also is connected to the next line directly or indirectly through the receiving and driving circuits for transmitting the signal in one direction or both directions between the said signal line and next one, and connected one by one repeatedly in the same way.

The Fourth Effect

According to the fourth characteristic of composition, as the signal lines are divided to the length which relates to the amount of the control means per unit composing the machine, the signal lines can be made composed with the rule, so there is the effect improving the efficiency of the assembly work. Moreover, the signal lines may be divided to the suitable length to correct the disordered signal wave by passing the said driving/receiving circuit and then there is the effect that the signal can be transmitted at high speed and stably at long distance even if the driving/receiving circuit and the transmitting circuit are not equilibrated not comprising the coaxial cable or the twisted pair wires.

The Fifth Characteristic of Composition

In addition, spindle direct motor drive system of spinning machine as characterized in claim 4, is characterized by that the said signal lines are composed of naked lines enclosed and insulated by the insulated resin made duct except the signal branch points, and there is the hard electric insulation mean between the stator of the said individual motor and the holder of the said spindle's bolster to support the bolster and it unites and covers the stator and the holder when it molds, and shapes the housing of the said individual motor, and the said signal lines are covered and supported by the second housing in front of the said individual motor housing.

The Fifth Effect

In addition to the effect of claim 4, according to the fifth characteristic of composition, because the said signal lines are composed of naked lines, enclosed and insulated by the insulated resin made duct except the signal branch points, the work of removing the insulating coating of wires is not necessary and the signal branch lines can be connected by means of inserting only the plugs or contacts attached at the end of the branch wires to the holes of the naked lines. And then, there is the effect that the assembly work becomes easy.

Because that the said signal lines are covered and supported by the second housing in front of the said motor housing which the electric insulation mean covers and shapes when it molds, the conventional sizable place or space are not specially necessary for installing the wiring duct. Also, it is possible to mount concentrically the inverter for controlling every one or more of the said individual motor, the power supply line branches, the control means and so on, with the power supply lines in front of the housing of the individual motors. This concentrated mounting will bring the effect of a redoubled miniaturization because of being able to omit connecting wires, control means and so on.

DETAILED DESCRIPTION OF THE PREFERRED EMBODIMENT

The preferred embodiment of the present invention (hereafter, it is said, "preferred embodiment") is explained referring to each figure.

Figure 1:
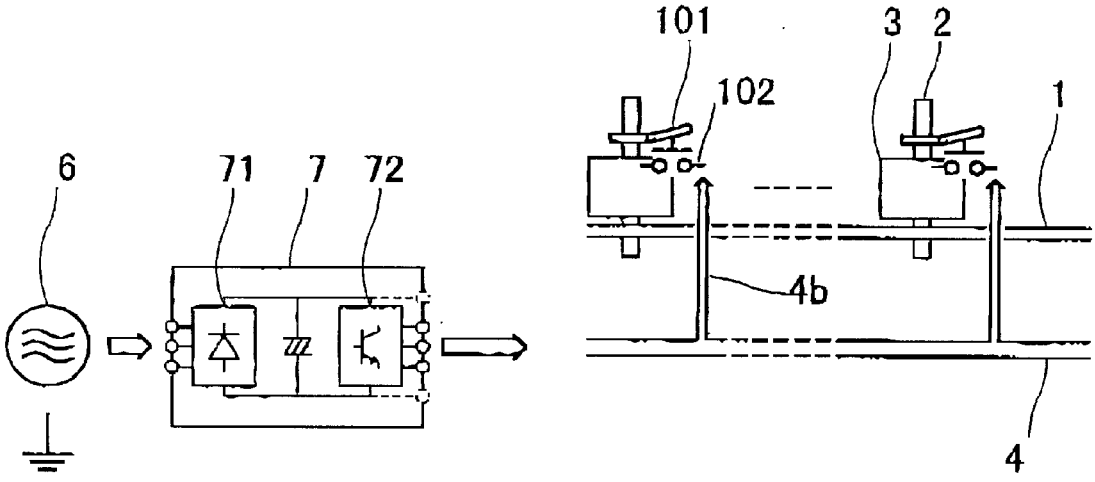
FIG. 1 shows the first system of the individual motors, the wiring system and the peripheral system of spindle direct motor drive system of the spinning machine.
Figure 2:
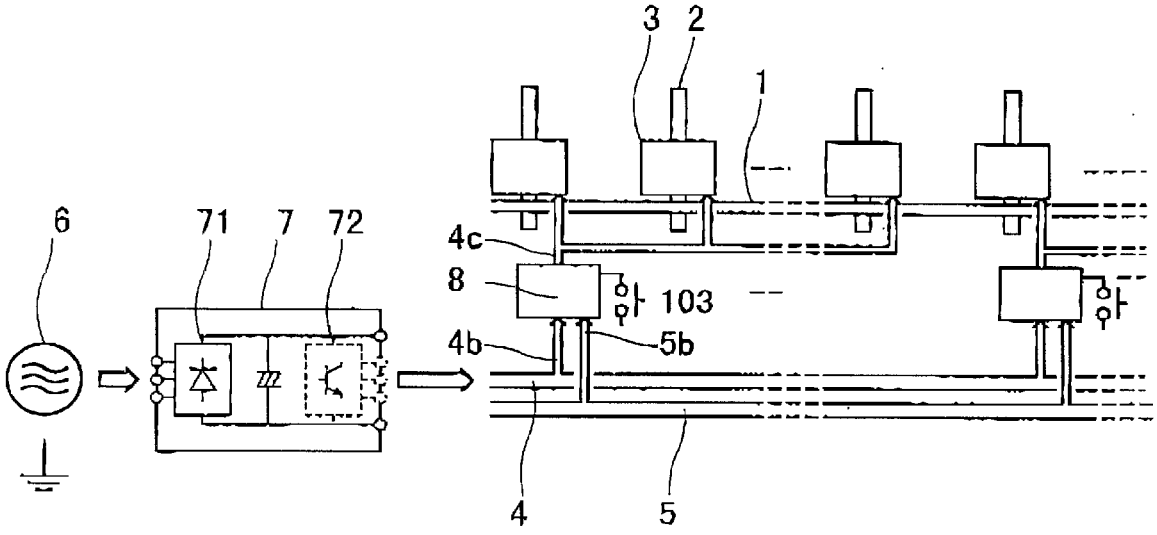
FIG. 2 shows the second system of the individual motors, the wiring system and the peripheral system of spindle direct motor drive system of the spinning machine.
Figure 3:
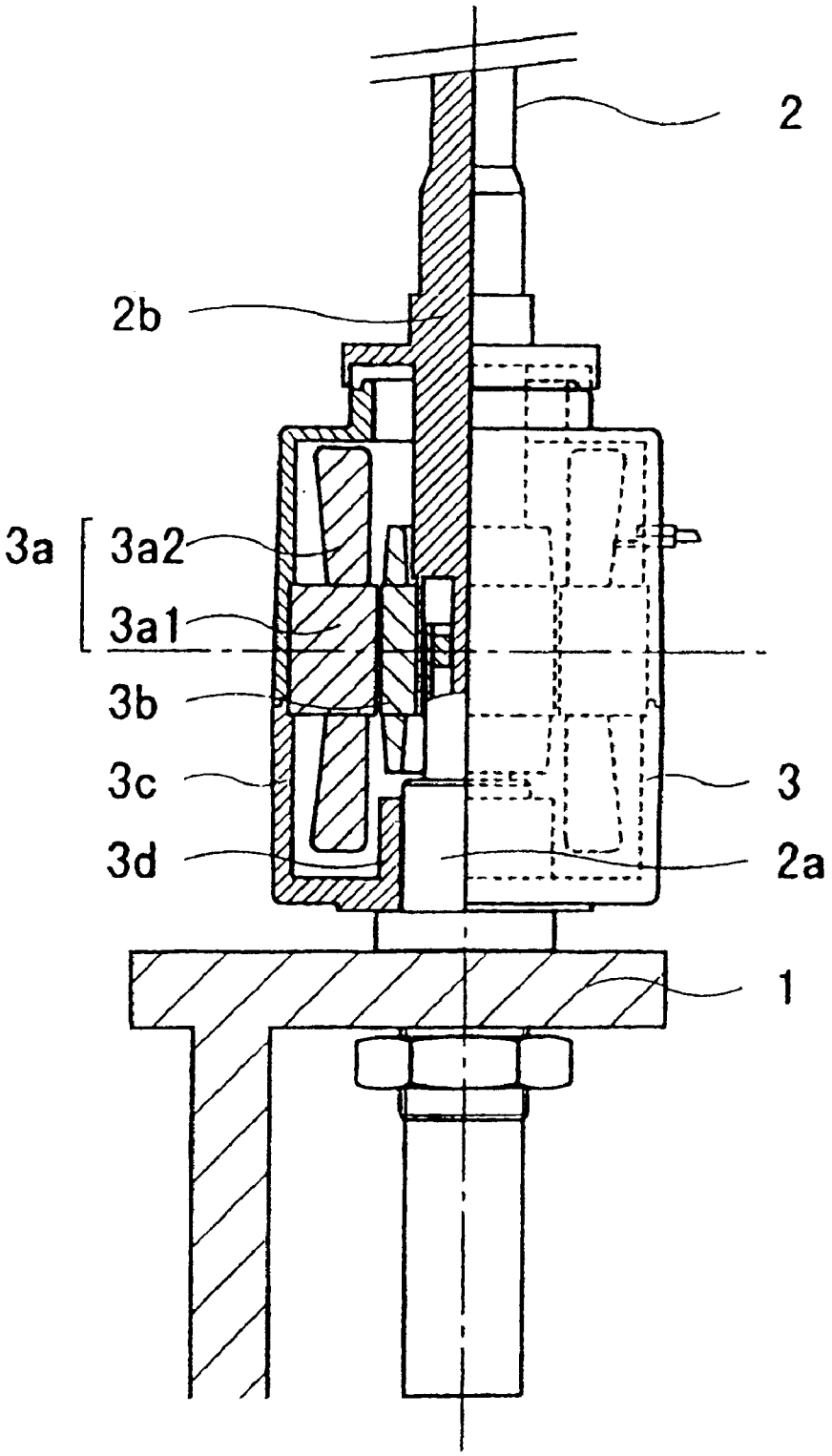
FIG. 3 Prior Art
FIG. 3 shows the conventional example of the individual motor's structure.
Figure 4:
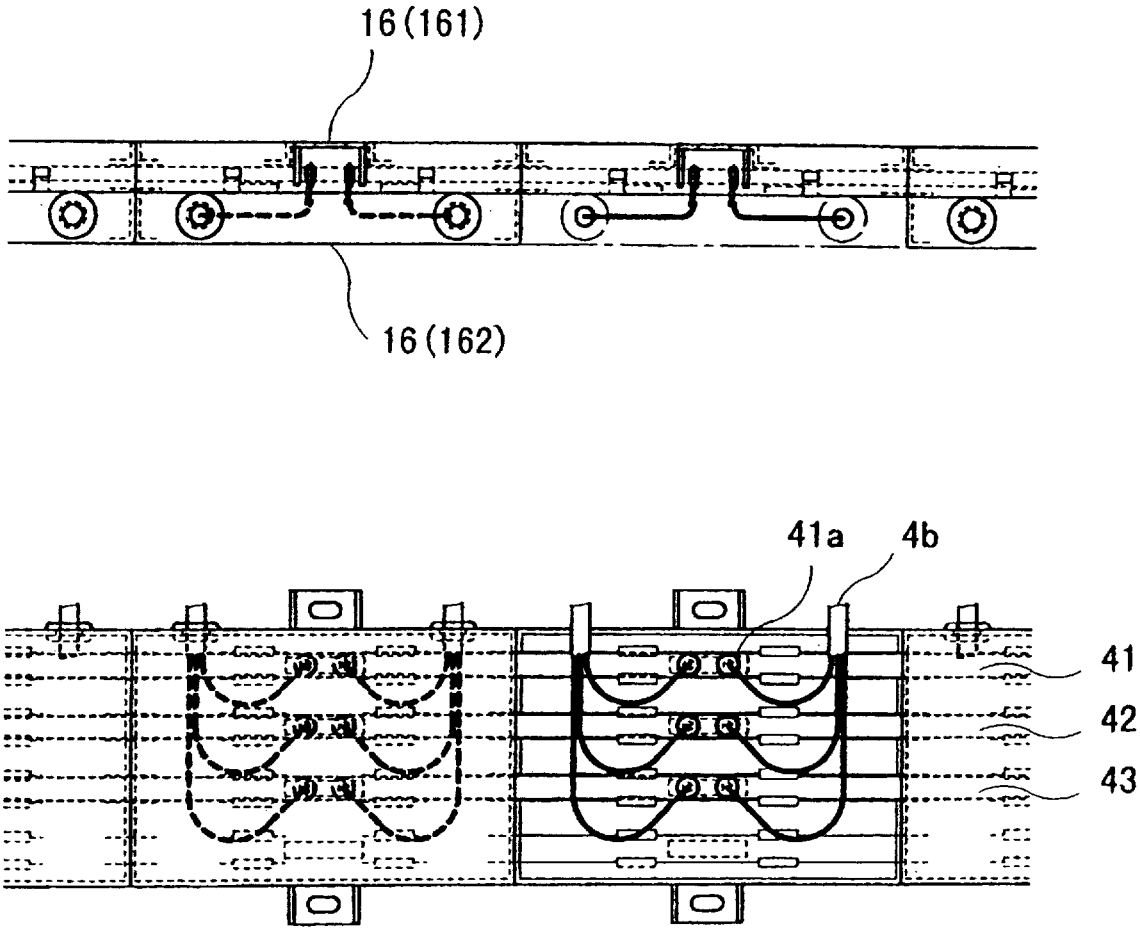
FIG. 4 Prior Art
FIG. 4 shows a conventional structure example of the wiring system of the first system.
Figure 5:
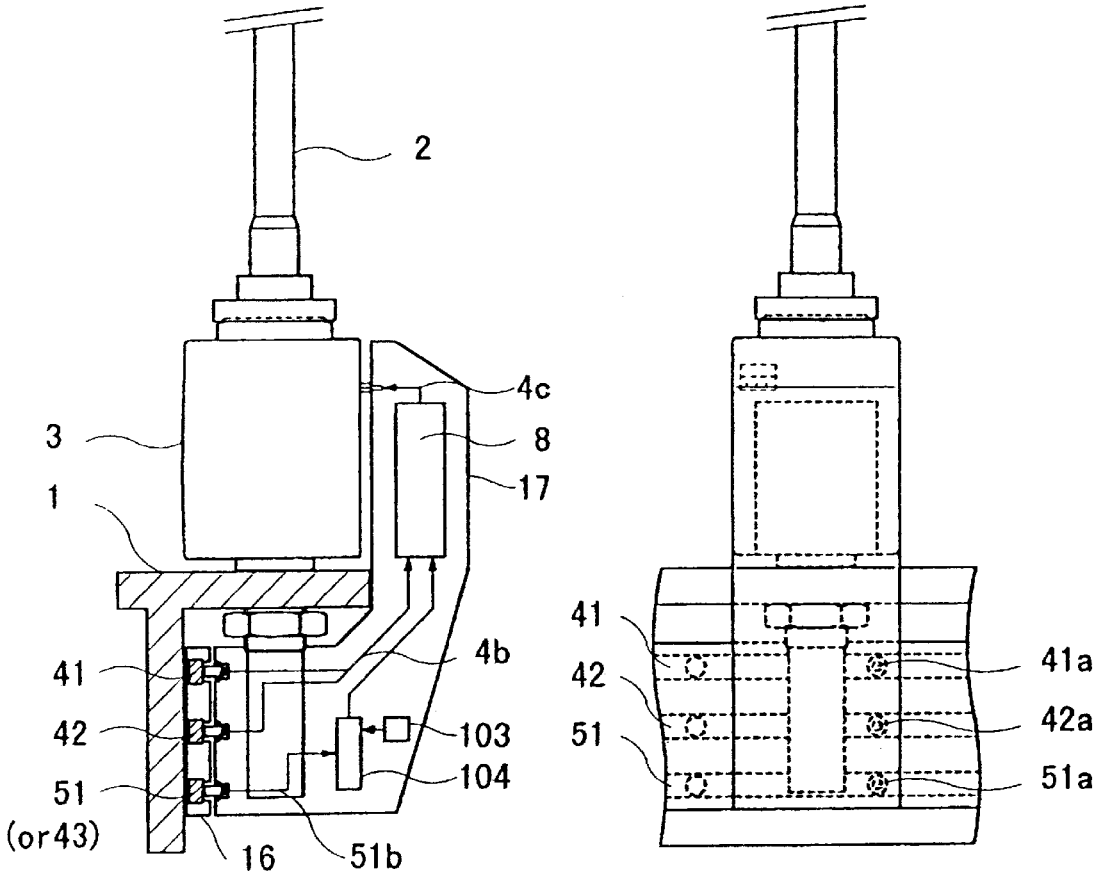
FIG. 5 Prior Art
FIG. 5 shows a conventional structure example of the individual motors, the wiring system and the peripheral system of the second system.
Figure 6:
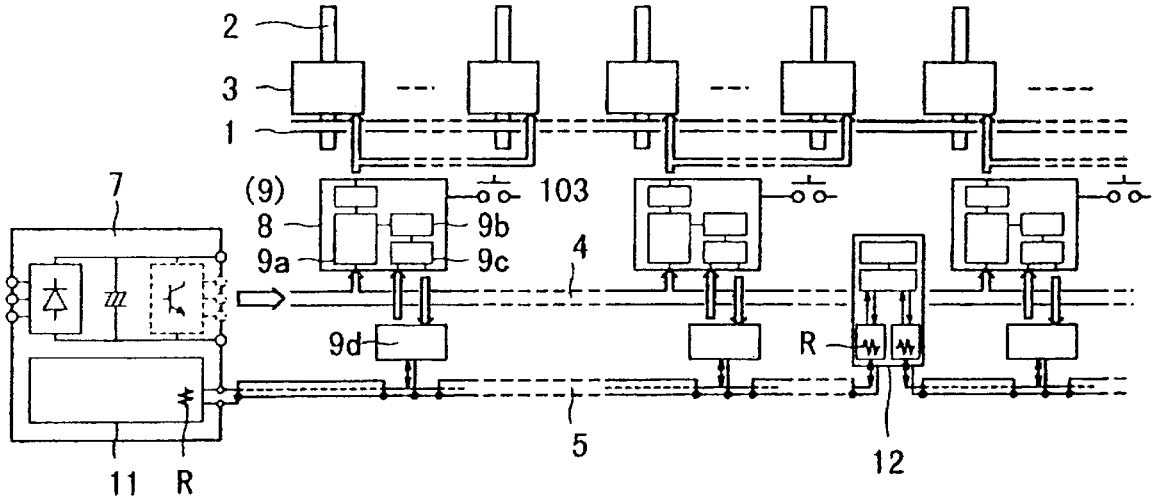
FIG. 6 Prior Art
FIG. 6 shows a conventional example of the signal transmission system of the individual motors, the wiring system and the peripheral system of the second system.
Figure 7:
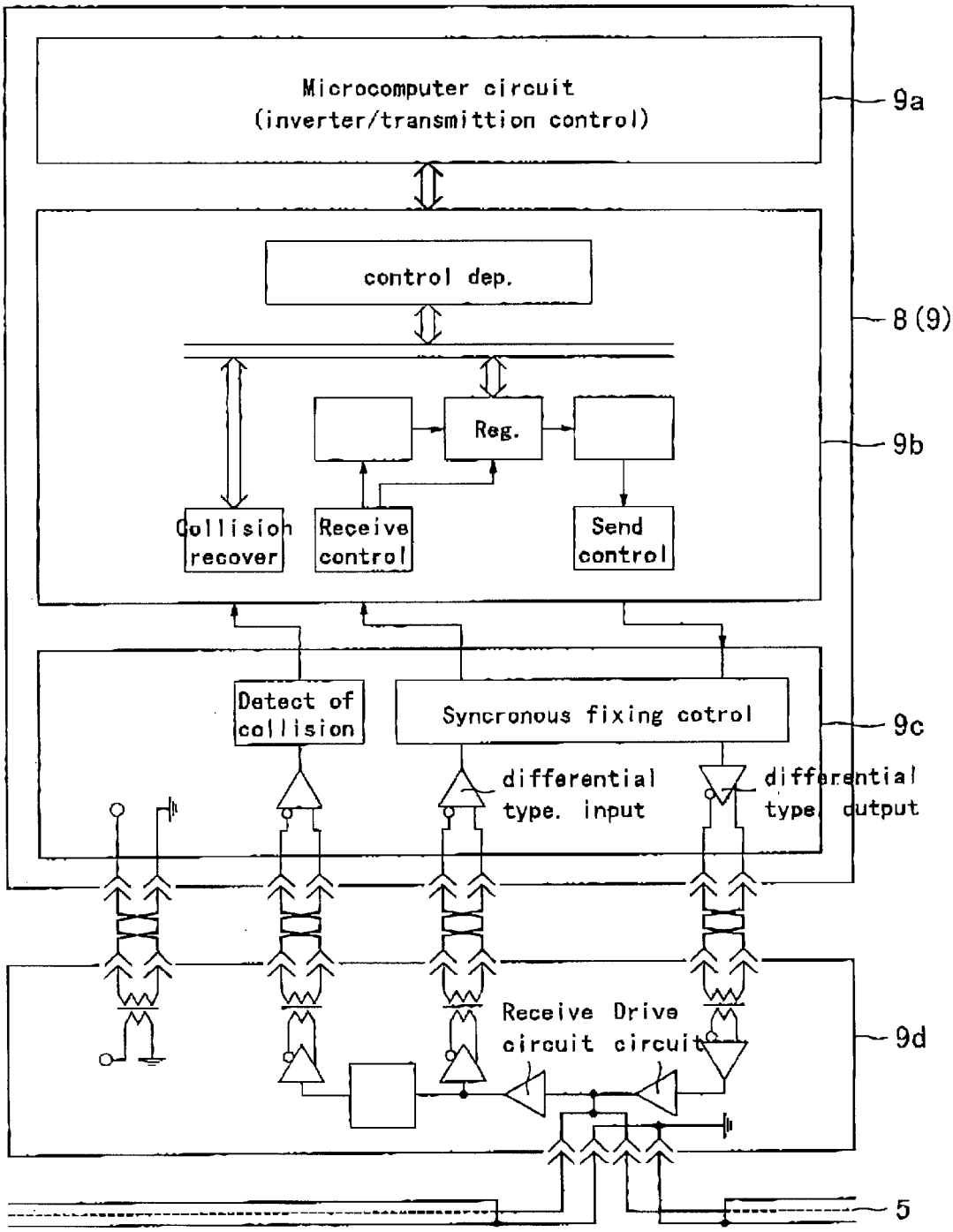
FIG. 7 shows a main circuit composition of each bureau in the LAN system.
Figure 8:
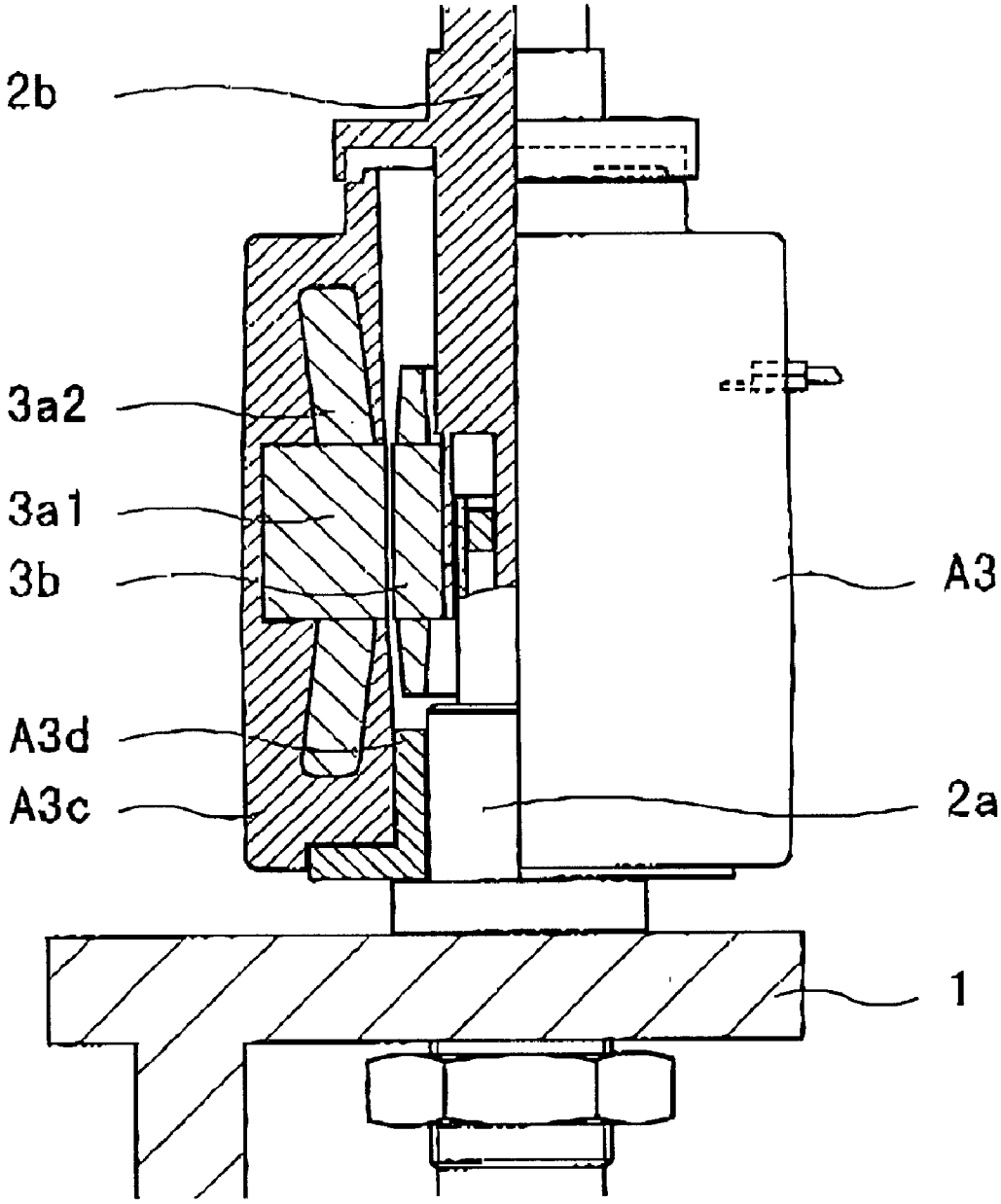
FIG. 8 shows a individual motor's structure as the executing example 1 of the present invention.

Preferred embodiment 1 is explained in FIG. 8. FIG. 8 shows a individual motor A3's structure. In state that the stator 3*a* and the metallic holder A3*d* of the bolster were put on a fixed position, when the electric insulation mean or the synthetic resin between them molds and shapes the housing A3*c* of the individual motor A3, it unites firmly the stator 3*a* and the metallic holder A3*d* and covers the stator 3*a*. The individual motor A3 can secure the characteristic to be proof against the voltage which corresponds to the power supply voltage by the winding wire 3*a*2 and the electric insulation mean in the route from the stator 3*a*'s winding wire 3*a*2, stator core 3*a*1, the housing A3*c*, the holder A3*d* of bolster, the bolster 2*a*, the ring rail 1, the frame of the machine body and to the earth. Even if the insulation destruction of the stator winding wire happens by any chance, the power supply voltage does not appear to the housing of an individual motor and the spindle bolster for person's hand to touch easily due to the insulation characteristic of the housing's material and structure. So there is no worry of the electric shock and the safety is secured.

Figure 9:
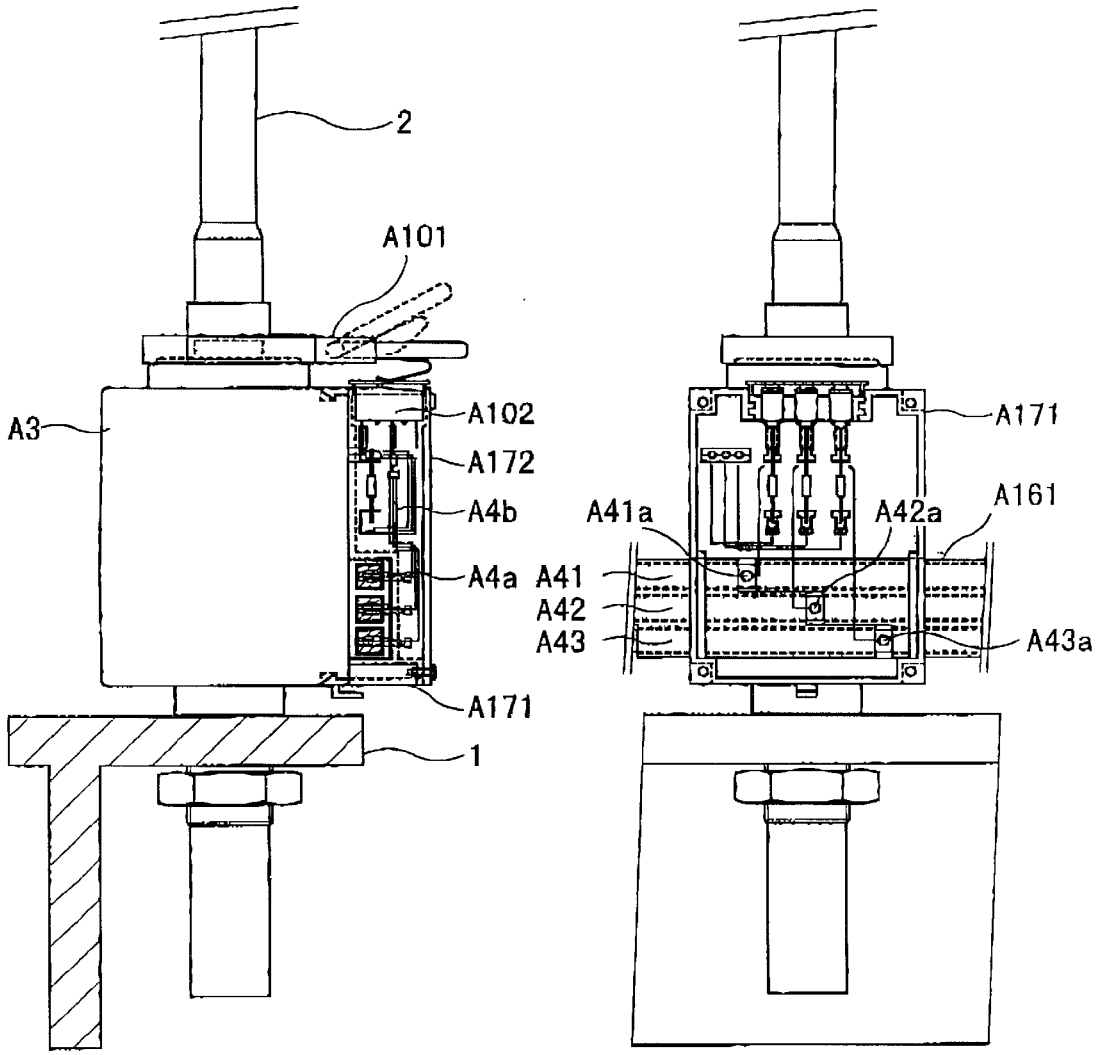
FIG. 9 shows the wiring system and peripheral system mounted in front of the housing of the individual motor as the executing example 2 of the present invention.

Preferred embodiment 2is explained in FIG. 9. The wiring system is composed of three phase alternating current power supply lines A41, A42 and A43 made of three naked copper bars and the wiring duct A161 made of insulation resin which encloses the each naked copper bar and fills the role of the insulating coating, and is installed in front of the insulating resin made housing A3*c* of the individual motor A3. And also the small and sealing up structural second housing A17 (second housing case A171 and second housing cover A172) which includes switch A102 working synchronously with braking device A101, power supply line branches A4*b*, control materials and so on, is installed as covering individual motor housing and wiring system. The wiring duct A161 is cut or removed at least partially at power supply branch points A4*a* of power supply lines A4, and there the naked copper bars are exposed. Because this power supply branch points A4*a* which are naked conductive parts are the distance apart from each other for insulation in the direction of the length of the power supply lines, the power supply lines A41, A42, and A42 can be arranged adjacently. As for the length of wiring duct A161, it is acceptable whether the length is corresponding to each individual motor or plural ones.

Figure 10:
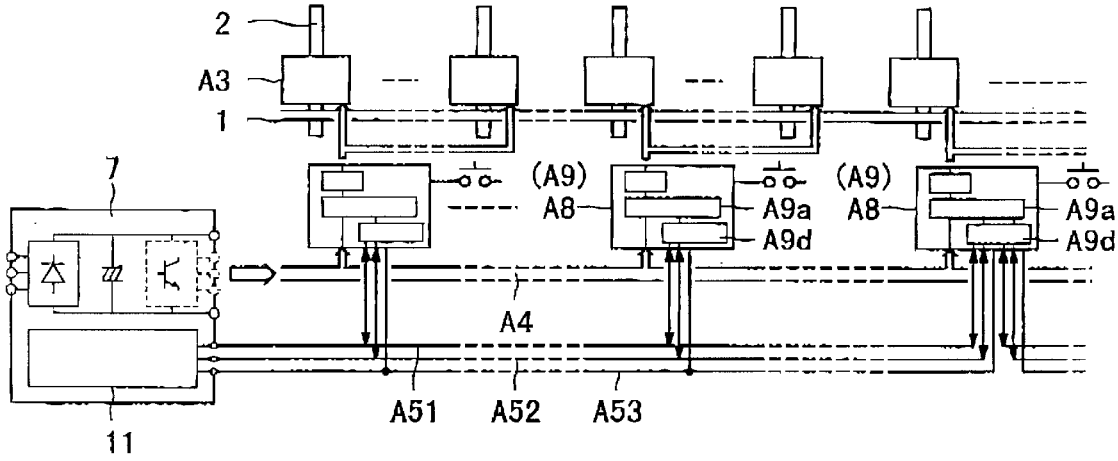
FIG. 10 shows the composition of the serial communication system as the executing example 3 of the present invention.
Figure 11:
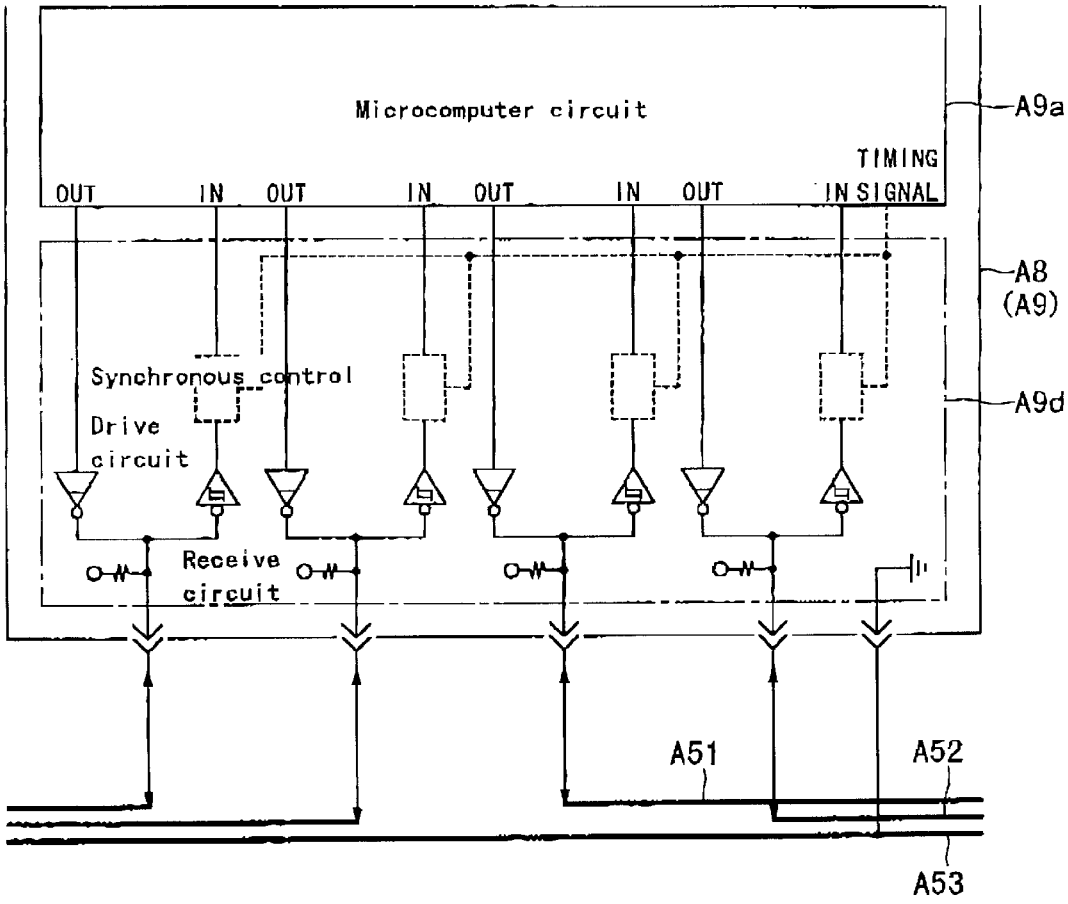
FIG. 11 shows the driving and receiving circuit between the signal lines and the inverter in the executing example 3 of the present invention.
Figure 12:
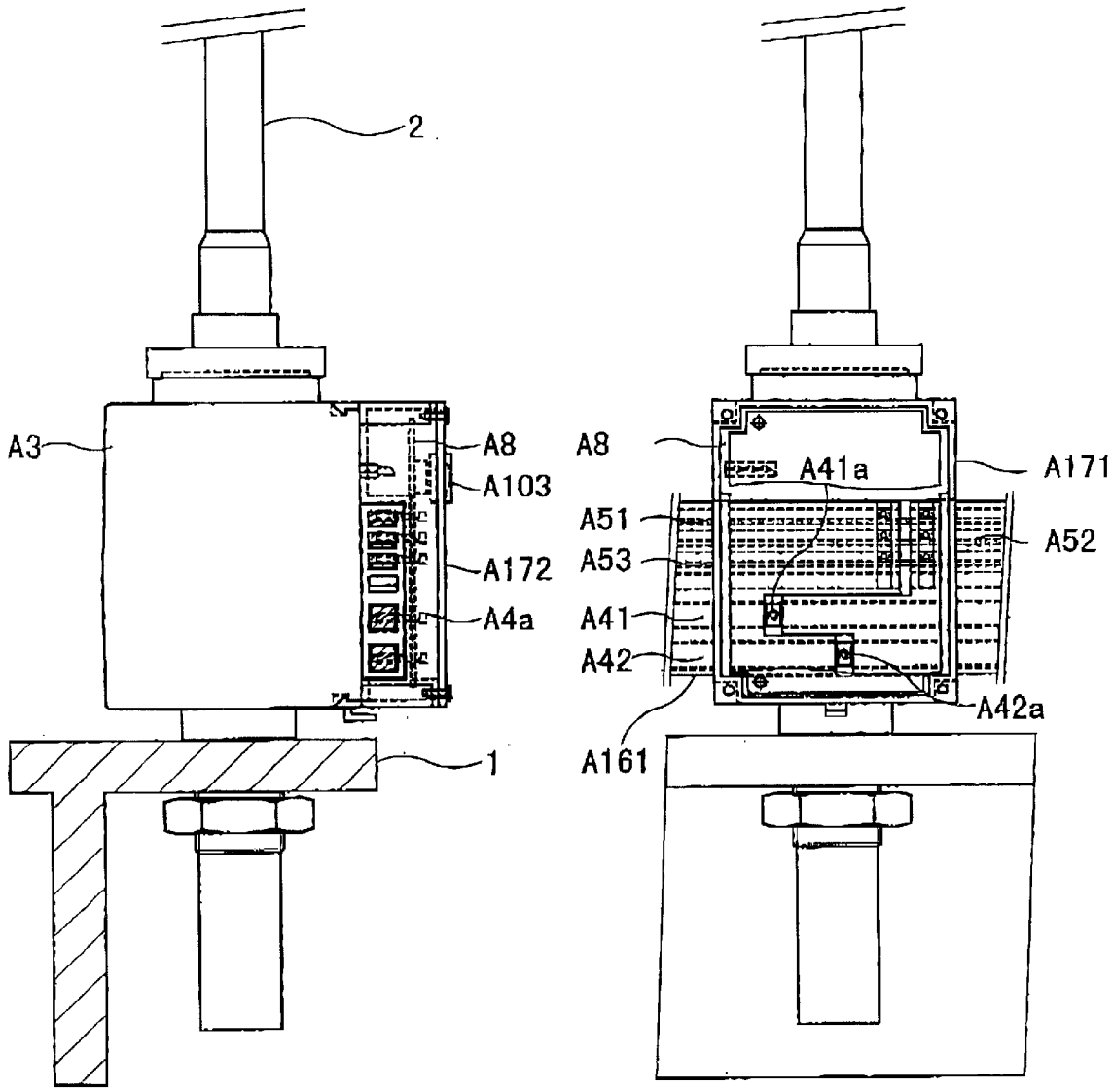
FIG. 12 shows the wiring system and peripheral system mounted in front of the housing of the individual motor of the executing example 3 of the present invention.

Preferred embodiment 3 is explained in FIG. 10~FIG. 12. FIG. 10 shows the composition of the serial communication system as the executing example 3 of the present invention-.The microcomputer circuit A9*a* of invertor A8 controls the communication of the bureau as same as the invertor. The wiring system comprises the power supply lines A4 and the signal lines A5. The signal lines include three lines, the data signal line A51 transmitted in both directions, the control signal line A52 transmitted in both directions and the common line A53. Because the invertor A8 can have the power supply circuit inside of itself, the control power supply line of low voltage is not always necessary. The signal lines A5 may be divided to the suitable length to correct the disordered signal wave induced by the load circuits number which the drive circuit can drive and the wiring impedance, etc. or to the suitable length to depend on the unit composing the machine. Because the driving and receiving circuit A9*d* relaying the signal at the divided point corrects the disordered signal wave and secures the drive capacity, the signal can be transmitted at high speed and stably at long distance even if the driving and receiving circuit and the transmitting circuit are not equilibrated as comprising the not equilibrated logic circuit and the naked copper bar.

FIG. 11 shows the driving and receiving circuit A9*d* between the signal lines A5 and the inverter A8 (the bureau A9) in the executing example 3 of the present invention. The microcomputer circuit A9*a* is connected with the data signal line A51 and the control signal line A52 each by the driving circuit and the receiving circuit for sending and receiving the both directional signals. The driving circuit is composed of the transistor circuit of emitter-earthed and collector opened output type and connected with the other bureau's driving circuit by wired-or connection. The receiving circuit has a hysteretic input characteristic.

FIG. 12 shows the wiring system and peripheral system mounted in front of the housing of the individual motor A3 of the executing example 3 of the present invention. A small wiring system composed of direct current power supply lines A41, A42, signal lines A51~A53 and wiring duct A161 made of the insulation resin, is arranged in front of the insulation resin made housing of the individual motor, being covered and supported by the housing case A171. And next, the inverter circuit board A8 is installed and connected with the power supply lines A41, A42 and the signal lines A51~A53 by the conductive contacts on the inverter circuit board A8. The stop switch A103 is connected with the inverter circuit A8, and finally the second housing cover A172 is installed, the inside of the second housing case A171 and the cover A172 is enclosed.

Because the wiring system is small, the inverter circuit board can be connected directly with every naked copper bar through the conductive contacts, and so the parts for the power supply lines, the signal lines and so on are unnecessary. Thus, the mounting structure inside of the second housing A17 becomes simple, and it is possible to make the second housing A17 small and to make the structure enclosed easily.

The present invention, the spindle direct motor drive system of the spinning machine exhibits the effects as the drive system of such as ring spinning machine, ring twister machine, and double twister machine. The structures of the individual motor, the wiring system and the peripheral system can be made small and simple and the cost of the system can be decreased.

What is claimed is:

1. Spinning machine which includes, a plurality of spindles which are arranged on the spindle rail installed in the direction of length of spinning machine, and a plurality of individual motors provided each for said spindle, for driving said spindles directly and individually, wherein the spindle direct motor drive system of spinning machine comprises at least two power supply lines for supplying power being arranged in the direction of length of spinning machine, or at least one signal line or more for sending or receiving the signal with control means for controlling the said individual motors being arranged for every one said individual motor or more, or at least two power supply lines and at least one signal line or more, any of them are mounted in front of the said motors being supported by the housing of the said individual motors or by the second housing fixed on the housing.

2. Spindle direct motor drive system of spinning machine as claimed in claim 1, wherein the said power supply lines, or the said signal lines, or the said power supply lines and the said signal lines, are composed of naked lines, enclosed and insulated by the insulation means at necessary parts.

3. Spindle direct motor drive system of spinning machine as claimed in claim 1, wherein the power supply branch points at which the conductive parts of the said power supply lines are exposed and from which the electric power are supplied to the said individual motors directly, or indirectly through the control means for controlling the said individual motors being arranged for every one or more of the said individual motors, are at least the distance apart from each other for insulation corresponding to the voltage between each other of the said power supply lines, in the direction of the length of the said power supply lines.

4. Spindle direct motor drive system of spinning machine as claimed in claim 2, wherein the power supply branch points at which the conductive parts of the said power supply lines are exposed and from which the electric power are supplied to the said individual motors directly, or indirectly through the control means for controlling the said individual motors being arranged for every one or more of the said individual motors, are at least the distance apart from each other for insulation corresponding to the voltage between each other of the said power supply lines, in the direction of the length of the said power supply lines.

5. Spindle direct motor drive system of spinning machine as claimed in claim 1, wherein the said signal lines are divided into the length corresponding to a fixed number of the said control means, and connected to each of the fixed number of the said control means through the receiving circuit or the receiving and driving circuits for transmitting the signal in one direction or both directions between the said signal lines and each of the said control means, and the divided said signal lines are connected to the next lines directly or indirectly through the receiving and driving circuits for transmitting the signal in one direction or both directions between the said signal lines and next ones, and also connected one by one repeatedly in the same way.

6. Spindle direct motor drive system of spinning machine as claimed in claim 2, wherein the said signal lines are divided into the length corresponding to a fixed number of the said control means, and connected to each of the fixed number of the said control means through the receiving circuit or the receiving and driving circuits for transmitting the signal in one direction or both directions between the said signal lines and each of the said control means, and the divided said signal lines are connected to the next lines directly or indirectly through the receiving and driving circuits for transmitting the signal in one direction or both directions between the said signal lines and next ones, and also connected one by one repeatedly in the same way.

7. Spindle direct motor drive system of spinning machine as claimed in claim 3, wherein the said signal lines are divided into the length corresponding to a fixed number of the said control means, and connected to each of the fixed number of the said control means through the receiving circuit or the receiving and driving circuits for transmitting the signal in one direction or both directions between the said signal lines and each of the said control means, and the divided said signal lines are connected to the next lines directly or indirectly through the receiving and driving circuits for transmitting the signal in one direction or both directions between the said signal lines and next ones, and also connected one by one repeatedly in the same way.

8. Spindle direct motor drive system of spinning machine as claimed in claim 1, wherein there is hard electric insulation mean between the stator of the said individual motor and the holder of the said spindle's bolster to support the bolster and it unites and covers and covers the stator and the holder when it molds, and shapes the housing of the said individual motor.

9. Spindle direct motor drive system of spinning machine as claimed in claim 2, wherein there is hard electric insulation mean between the stator of the said individual motor and the holder of the said spindle's bolster to support the bolster and it unites and covers and covers the stator and the holder when it molds, and shapes the housing of the said individual motor.

10. Spindle direct motor drive system of spinning machine as claimed in claim 3, wherein there is hard electric insulation mean between the stator of the said individual motor and the holder of the said spindle's bolster to support the bolster and it unites and covers and covers the stator and the holder when it molds, and shapes the housing of the said individual motor.

11. Spindle direct motor drive system of spinning machine as claimed in claim 4, wherein there is hard electric insulation mean between the stator of the said individual motor and the holder of the said spindle's bolster to support the bolster and it unites and covers and covers the stator and the holder when it molds, and shapes the housing of the said individual motor.

12. Spinning machine which includes:

a plurality of spindles which are arranged on the spindle rail installed in the direction of length of spinning machine, and a plurality of individual motors provided each for said spindle, for driving said spindles directly and individually, wherein the spindle direct motor drive system comprises, at least two power supply lines for supplying power being arranged along the said spindle rail, and the power supply branch points at which the conductive.

* * * * *

UNITED STATES PATENT AND TRADEMARK OFFICE

CERTIFICATE OF CORRECTION

PATENT NO. : 6,393,816 B1
DATED : May 28, 2002
INVENTOR(S) : Motonobu Hattori

It is certified that error appears in the above-identified patent and that said Letters Patent is hereby corrected as shown below:

Column 10,
Lines 7, 16, 24 and 32, remove "and covers".
Line 45, after "conductive." delete the "." and insert -- parts of the said power supply lines are exposed and from which the electric power are supplied to the said individual motors directly, or indirectly through the control means for controlling one or more of the said individual motors, and also which are at least the distance apart from each other for insulation corresponding to the voltage between each other of the said power supply lines, in the direction of the length of the said power supply lines. --

Signed and Sealed this

Fifteenth Day of April, 2003

JAMES E. ROGAN
*Director of the United States Patent and Trademark Office*